US008024932B1

(12) United States Patent
Stewart

(10) Patent No.: US 8,024,932 B1
(45) Date of Patent: Sep. 27, 2011

(54) SYSTEM AND METHOD FOR A COMBUSTOR NOZZLE

(75) Inventor: Jason Thurman Stewart, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/755,747

(22) Filed: Apr. 7, 2010

(51) Int. Cl.
*F02C 1/00* (2006.01)

(52) U.S. Cl. ..... 60/748; 60/737; 60/740; 60/772

(58) Field of Classification Search ..... 60/737, 60/740, 742, 748, 772, 804; 239/399, 403, 239/590, 590.5
See application file for complete search history.

(56) References Cited

U.S. PATENT DOCUMENTS 3,038,698 A * 6/1962 Troyer ..... 415/12
6,438,961 B2 8/2002 Tuthill et al.
6,993,916 B2 2/2006 Johnson et al.

* cited by examiner

*Primary Examiner* — Ehud Gartenberg
*Assistant Examiner* — Arun Goyal
(74) *Attorney, Agent, or Firm* — Dority & Manning, P.A.

(57) ABSTRACT

A nozzle includes a center body and a shroud circumferentially surrounding at least a portion of the center body to define an annular passage between the center body and the shroud. The nozzle further includes a bimetallic guide between the center body and the shroud. A method for supplying fuel to a combustor includes flowing a working fluid through a nozzle, injecting the fuel into the nozzle, and mixing the fuel with the working fluid to create a fuel and working fluid mixture. The method further includes swirling the fuel and working fluid mixture, sensing flame holding in the nozzle, and reducing the swirl in the fuel and working fluid mixture.

20 Claims, 9 Drawing Sheets

SYSTEM AND METHOD FOR A COMBUSTOR NOZZLE

FIELD OF THE INVENTION

The present invention generally involves a combustor. In particular, the present invention describes and enables a nozzle for a combustor and a method for responding to flame holding conditions in the fuel nozzle.

BACKGROUND OF THE INVENTION

Combustors are commonly used in many forms of commercial equipment. For example, gas turbines typically include one or more combustors that mix fuel with a working fluid to generate combustion gases having a high temperature, pressure, and velocity. Many combustors include nozzles that premix the fuel with the working fluid prior to combustion. Premixing the fuel with the working fluid prior to combustion allows for leaner fuel mixtures, reduces undesirable emissions, and/or improves the overall thermodynamic efficiency of the gas turbine.

During normal combustor operations, a combustion flame exists downstream from the nozzles, typically in a combustion chamber at the exit of the nozzles. Occasionally, however, an event referred to as "flame holding" occurs in which a combustion flame exists upstream of the combustion chamber inside the nozzles. For example, conditions may exist in which a combustion flame exists near a fuel port in the nozzles or near an area of low flow in the nozzles. Nozzles are typically not designed to withstand the high temperatures created by flame holding, and flame holding may therefore cause severe damage to a nozzle in a relatively short amount of time.

Various methods are known in the art for preventing or reducing the occurrence of flame holding. For example, flame holding is more likely to occur during the use of higher reactivity fuels or during the use of higher fuel-to-working-fluid ratios. Flame holding is also more likely to occur during operations in which the fuel-working fluid mixture flows through the nozzles at lower velocities. Combustors may therefore be designed with specific safety margins for fuel reactivity, fuel-to-working-fluid ratios, and/or fuel-working fluid mixture velocity to prevent or reduce the occurrence of flame holding. While the safety margins are effective at preventing or reducing the occurrence of flame holding, they may also result in reduced operating limits, additional maintenance, reduced operating lifetimes, and/or reduced overall thermodynamic efficiency. Therefore, a nozzle, combustor, and/or method for operating the combustor to respond to flame holding would be desirable.

BRIEF DESCRIPTION OF THE INVENTION

Aspects and advantages of the invention are set forth below in the following description, or may be obvious from the description, or may be learned through practice of the invention.

One embodiment of the present invention is a nozzle that includes a center body and a shroud circumferentially surrounding at least a portion of the center body to define an annular passage between the center body and the shroud. The nozzle further includes a bimetallic guide between the center body and the shroud.

Another embodiment of the present invention is a combustor. The combustor includes an end cap and a nozzle disposed in the end cap. The nozzle includes a shroud that defines an annular passage in the nozzle and a bimetallic guide disposed in the annular passage.

The present invention also includes a method for supplying fuel to a combustor. The method includes flowing a working fluid through a nozzle, injecting the fuel into the nozzle, and mixing the fuel with the working fluid to create a fuel and working fluid mixture. The method further includes swirling the fuel and working fluid mixture, sensing flame holding in the nozzle, and reducing the swirl in the fuel and working fluid mixture.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying Figures, in which.

DETAILED DESCRIPTION OF THE INVENTION

Figure 1:
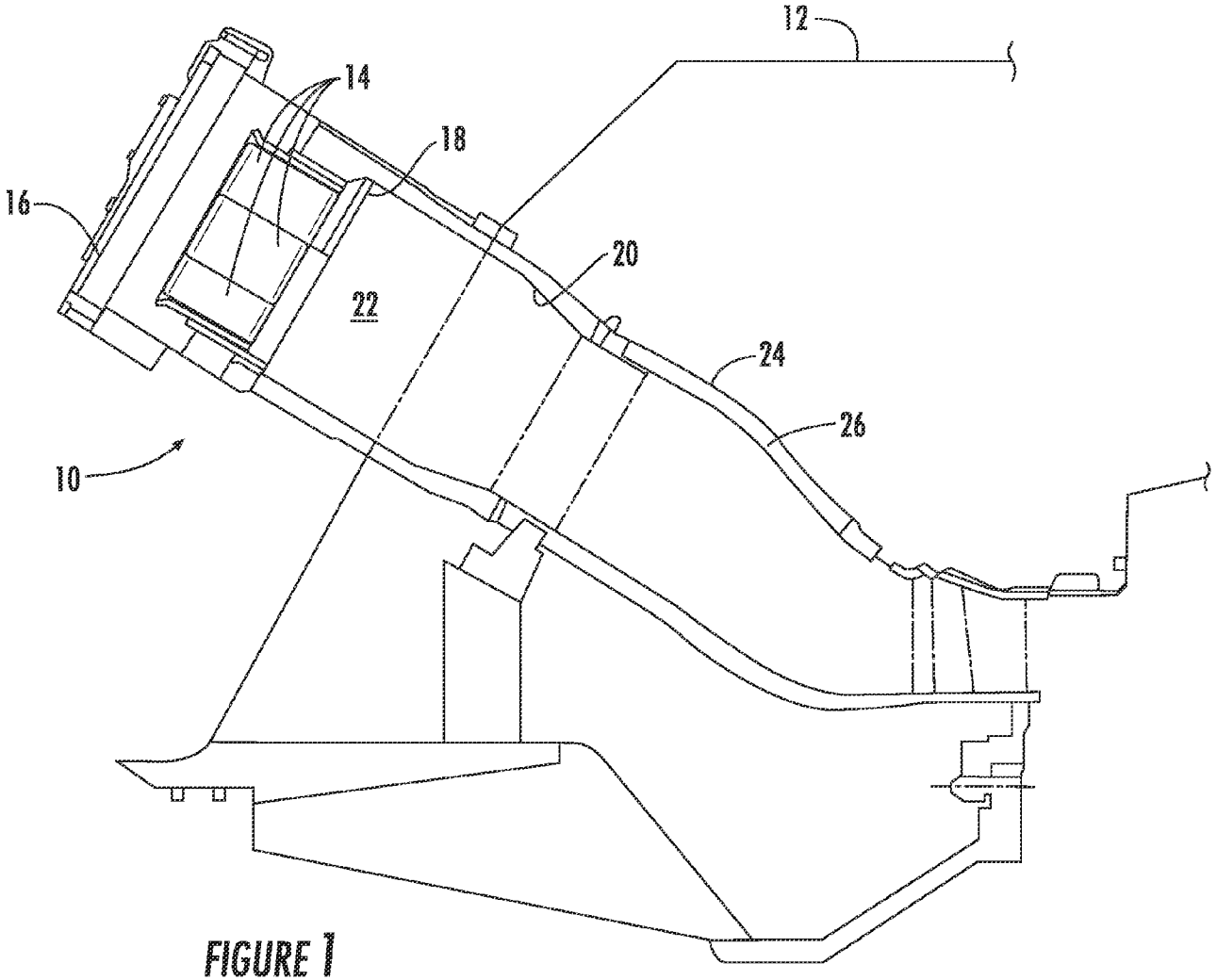
FIG. 1 is a simplified cross-section of a combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include an active device that minimizes or prevents damage to a nozzle or combustor caused by flame holding. When flame holding occurs, the active device reduces the swirling of fuel and working fluid flowing through the nozzle. The reduced swirling of fuel and working fluid in the nozzle in which flame holding is occurring allows that nozzle to "borrow" additional working fluid from adjacent nozzles, thus increasing the axial velocity and/or mass flow rate of the fuel and working fluid mixture to effectively push the combustion flame out of the nozzle. In addition, assuming a constant fuel mass flow rate, the increased mass flow rate working fluid reduces the ratio of fuel-to-working-fluid. The reduced fuel-to-working-fluid ratio further aids to extinguish or remove the combustion flame from the nozzle. When flame holding no longer exists, the active device returns to its previous position to impart swirling to or allow swirling of the fuel and working fluid flowing through the nozzle.

By responding to flame holding, the active device may provide an increase in margins before the onset of flame holding or allow for less restrictive operating limits during normal operations. For example, the ability of the active device to respond to flame holding may allow for the use of fuels with higher reactivity, less restrictive design limitations on the location of fuel injection, and fewer forced outages caused by flame holding. As a further example, the active device may allow for reduced nozzle velocities during normal operations, resulting in reduced pressure losses across the nozzle and increased thermodynamic efficiency.

FIG. 1 provides a simplified cross-section of a combustor 10 according to one embodiment of the present invention. A casing 12 surrounds the combustor 10 to contain a compressed working fluid. Nozzles 14 are arranged in an end cover 16 and an end cap 18, and a liner 20 downstream of the nozzles 14 defines a combustion chamber 22. A flow sleeve 24 surrounds the liner 20 to define an annular passage 26 between the flow sleeve 24 and the liner 20. The compressed working fluid flows through the annular passage 26 toward the end cover 16 where it reverses direction to flow through the nozzles 14 and into the combustion chamber 22.

Figure 2:
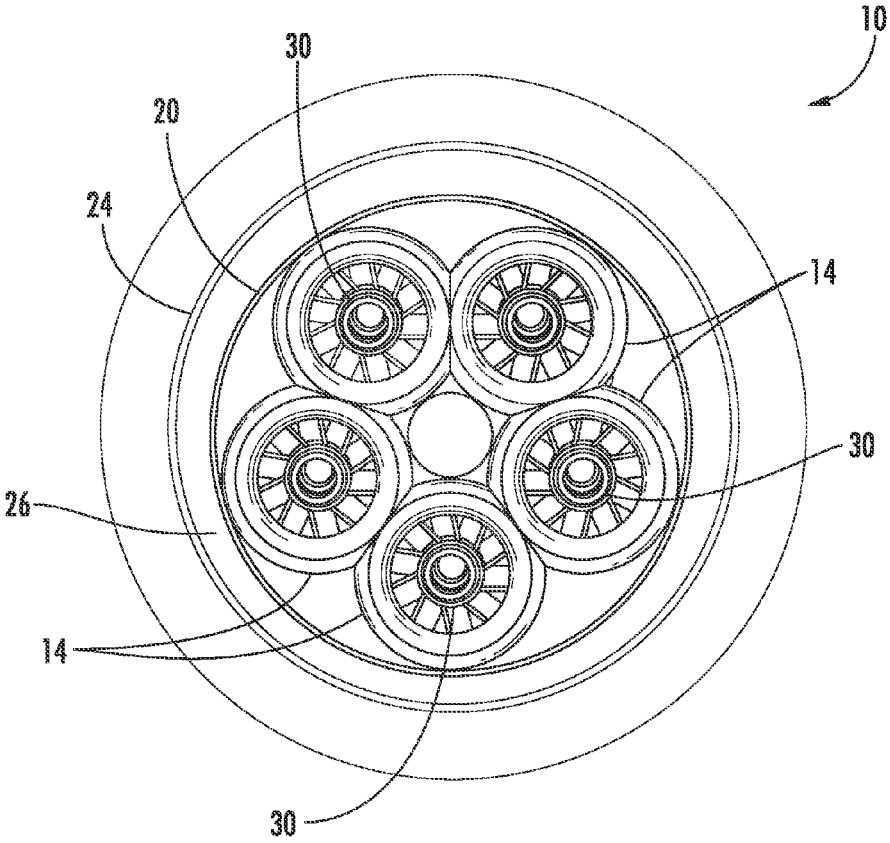
FIG. 2 is a top plan view of the combustor shown in FIG. 1.

FIG. 2 provides a top plan view of the combustor 10 shown in FIG. 1. Various embodiments of the combustor 10 may include different numbers and arrangements of nozzles. For example, in the embodiment shown in FIG. 2, the combustor 10 includes five nozzles 14 radially arranged. The working fluid flows through the annular passage 26 between the flow sleeve 24 and the liner 20 until it reaches the end cover 16 where it reverses direction to flow through the nozzles 14 and into the combustion chamber 22.

Figure 3:
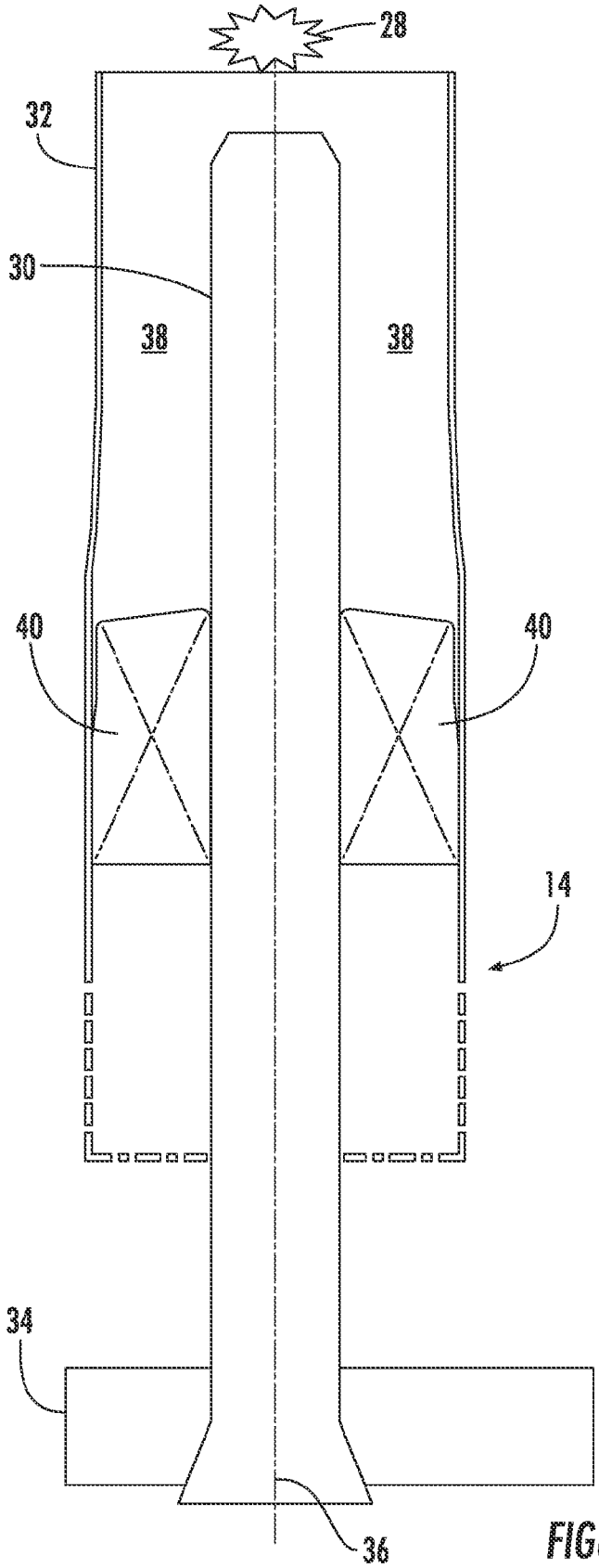
FIG. 3 is a cross-section of a nozzle according to one embodiment of the present invention.

FIG. 3 shows a simplified cross-section of the nozzle 14 according to one embodiment of the present invention. As shown in FIG. 3, a combustion flame 28 exists downstream of the nozzle 14 in the combustion chamber 22 during normal operations. The nozzle 14 generally includes a center body 30 and a shroud 32, although alternate embodiments within the scope of the present invention may include a shroud 32 without a center body 30. The center body 30, if present, may connect at one end to a nozzle flange 34 and extends along an axial centerline 36 of the nozzle 14. The shroud 32 circumferentially surrounds at least a portion of the center body 30 to define an annular passage 38 between the center body 30 and the shroud 32. Fuel may be supplied to the center body 30 and injected into the annular passage 38 to mix with the working fluid. Vanes 40 may impart a tangential velocity to the fuel and working fluid mixture to evenly mix the fuel and working fluid before it reaches the combustion chamber 22. If the center body 30 is not present, the shroud 32 may define a circular passage within the circumference of the shroud 32, and fuel may again be supplied through the circular passage 38.

Figure 4:
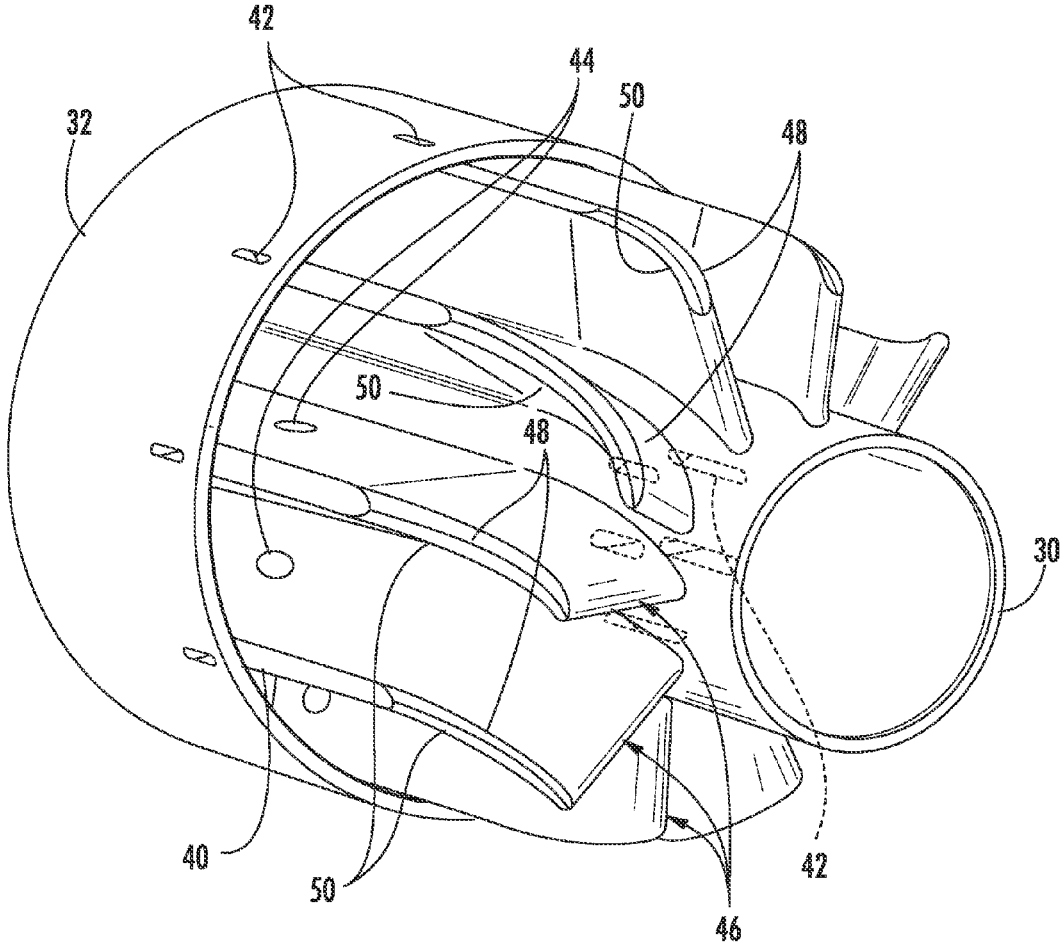
FIG. 4 is a perspective view of a partial cutaway of the nozzle shown in FIG. 3.

FIG. 4 provides a perspective view of a partial cutaway of the nozzle 14 shown in FIG. 3 during normal operations. As shown in FIG. 4, the vanes 40 may include an internal passage 42 that allows fluid communication for the fuel to flow from the center body 30 and/or the shroud 32 into the vanes 40. In this manner, the fuel may be injected into the annular passage 38 through fuel ports 44 on either side of the center body 30, the inside of the shroud 32, and/or either side of the vanes 40. The diameter and angle of the fuel ports 44 combine to ensure that the fuel adequately penetrates into the annular passage 38 and to prevent the fuel from simply streaming along the center body 30, the shroud 32, and/or the vanes 40. The diameter and angle of the fuel ports 44 also combine to reduce the occurrence of flame holding in the vicinity of the fuel ports 44.

As shown in FIG. 4, the vanes 40 may include bimetallic guides 46 to direct the flow of fuel and working fluid mixture through the nozzle 14. The bimetallic guides 46 may be coextensive or integral with the vanes 40, as shown in FIG. 4. In alternate embodiments, the bimetallic guides 46 may be disposed in the annular passage 38 downstream and separate from the vanes 40. Each bimetallic guide 46 generally includes at least two layers of different metals having different temperature coefficients of expansion. The metal layers may be joined using any joining technique known in the metal joining art, such as riveting, bolting, soldering, clinching, adhering, brazing, and welding. For example, each bimetallic guide 46 may include a metal layer of steel 48 joined to a metal layer of copper or brass 50. The specific bimetallic metals used in the bimetallic guides 46 are not limited to steel, copper, or brass, and may include any combination of metals having suitable temperature coefficients of expansion. The difference in the temperature coefficients of expansion causes the two layers of different metals to expand or retract by different amounts in response to a change in temperature, changing the curvature of the bimetallic guides 46.

The combination of the angle of the vanes 40 and/or the curvature of the bimetallic guides 46 determines the direction, mass flow rate, axial velocity, and angular velocity of the fuel and working fluid mixture. For example, as shown in FIG. 4, the vanes 40 may be disposed in the annular passage 38 substantially parallel to the axial centerline 36 of the nozzle 14, and the bimetallic guides 46 may be curved so that the combination of the vanes 40 and the bimetallic guides 46 imparts swirl to the fuel and working fluid mixture. The swirl created by the vanes 40 and the bimetallic guides 46 reduces the axial velocity and/or mass flow rate of the nozzle 14, compared to a nozzle without any swirl, and increases the tangential velocity of the fuel and working fluid mixture to provide stability in a swirl stabilized combustor and also to enhance the mixing of the fuel and working fluid before it reaches the combustion chamber 22.

Figure 5:
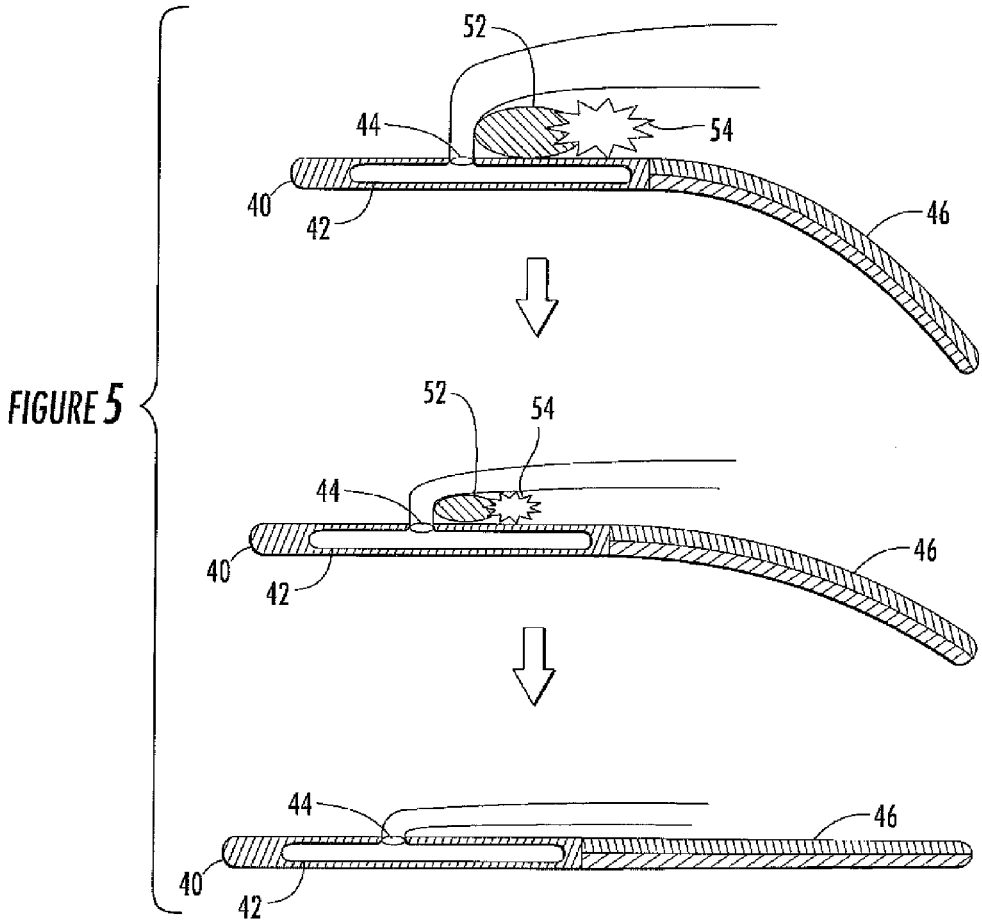
FIG. 5 illustrates the response of a bimetallic guide to a flame holding event near a fuel port according to one embodiment of the present invention.
Figure 6:
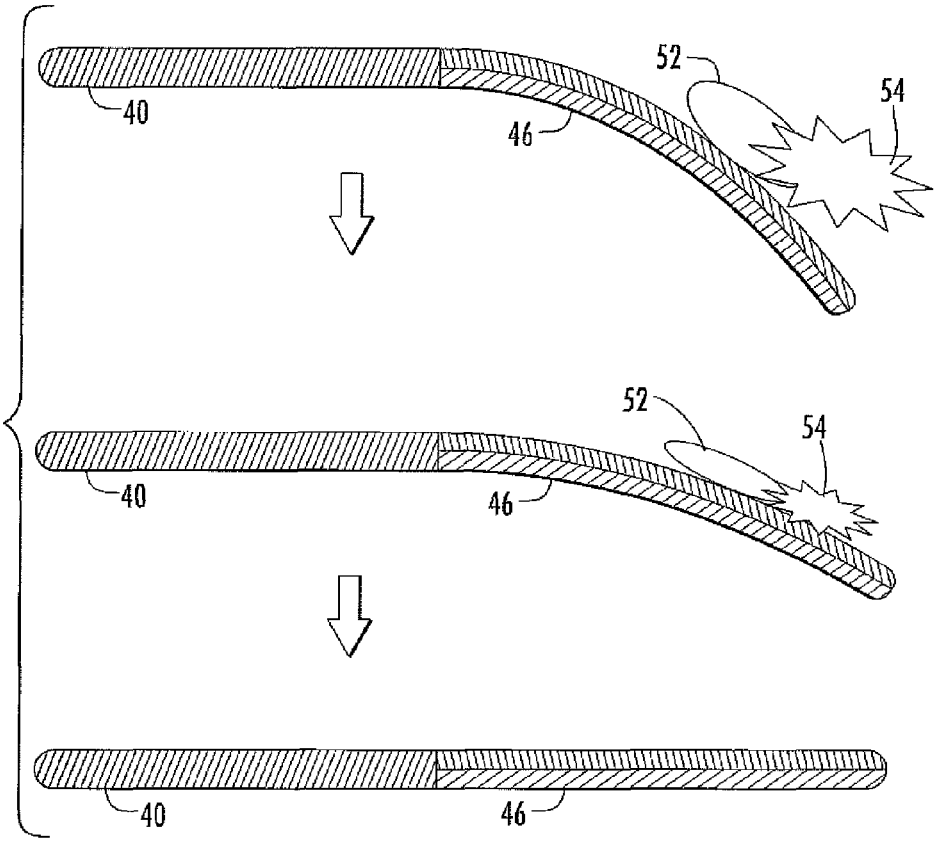
FIG. 6 illustrates the response of a bimetallic guide to a flame holding event near a low flow region according to one embodiment of the present invention.

FIGS. 5 and 6 illustrate the response of the bimetallic guides 46 to flame holding that may occur in two areas known to be susceptible to flame holding. Referring to FIG. 5, the area immediately downstream of the fuel port 44 typically has a relatively high concentration of fuel and a relatively low axial velocity of working fluid. As a result, an attachment point 52 for a combustion flame 54 may form immediately downstream of the fuel port 44. As shown in FIG. 5, the mass flow of the working fluid is increasing through the nozzle as the bimetallic guides 46 straighten. Assuming a constant fuel flow rate to that nozzle, the fuel jet penetration is reduced, and, therefore, so is the recirculation or low velocity zone size just downstream of the fuel jet. Reducing this low velocity zone size downstream of the jet will at some point remove the stability of the flame 54 and push it out of the nozzle. This all happens because the fuel jet penetration is lowered, assuming a constant fuel flow rate. In addition, since the working fluid mass flow increases and the fuel flow remains constant, the fuel to working fluid ratio decreases which also helps to extinguish the flame 54.

Referring to FIG. 6, the low pressure side of the vane 40 and/or bimetallic guide 46 may create an area of relatively low axial velocity, or even a recirculation bubble, of working fluid, creating another attachment point 52 for a combustion flame 54. As the bimetallic guide 46 straightens, swirling is reduced, and the fuel and working fluid mixture moves closer to the guide 46. This also evens out the flow velocities in adjacent vanes, which reduces the occurrence of low velocity zones (i.e., reduces zones of low velocity even if separation does not occur). These two actions makes it more difficult for the flame 54 to anchor, and ultimately the flame 54 is pushed out of the nozzle.

In each situation illustrated in FIGS. 5 and 6, the flame holding creates a temperature increase in the vicinity of the bimetallic guide 46, causing the bimetallic guide 46 to straighten. In some embodiments, the bimetallic guide 46 may become completely straight in response to flame holding, while in other embodiments, the flame holding may merely reduce the curvature in the bimetallic guide 46. As the bimetallic guide 46 straightens, as shown in FIGS. 5 and 6, the axial velocity and/or mass flow rate of the working fluid increases (because the nozzle with flame holding "borrows" additional working fluid from adjacent nozzles) to effectively blow the flame holding out of the nozzle 14. The increased axial velocity and/or mass flow rate of the working fluid reduces the size of the attachment point 52 for the combustion flame 54. In addition, the increased axial velocity and/or mass flow rate of the working fluid through the nozzle 14, assuming a constant fuel flow, reduces the ratio of fuel to working fluid, further reducing the chance of flame holding.

Figure 7:
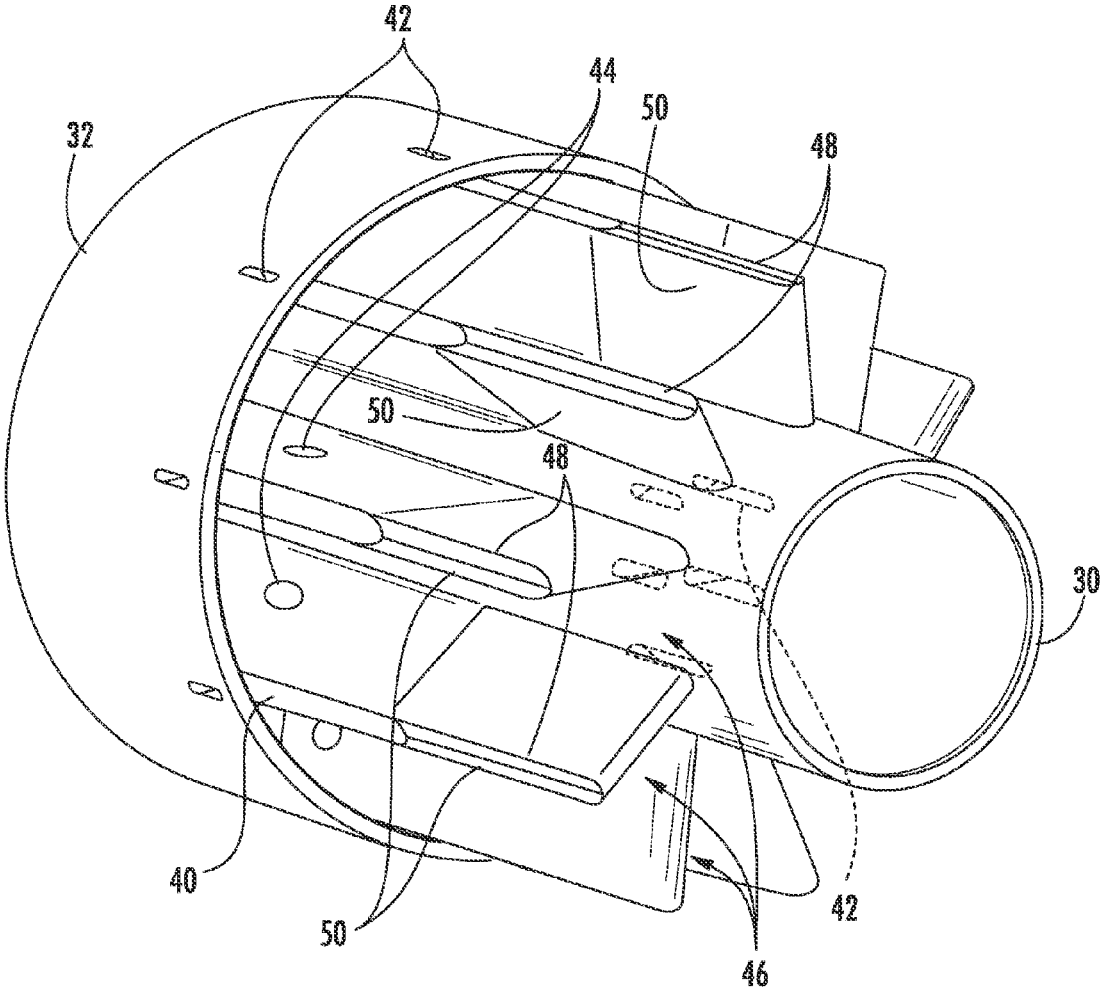
FIG. 7 is a perspective view of a partial cutaway of the nozzle shown in FIG. 3 responding to flame holding.

FIG. 7 provides a perspective view of a partial cutaway of the nozzle 14 shown in FIG. 3 responding to flame holding. The flame holding in the vicinity of the bimetallic guides 46 produced an increase in the temperature in the vicinity of the bimetallic guides 46. As a result, the bimetallic guides 46, comprised of two metals having different temperature coefficients of expansion, straightened, as shown in FIG. 7. As previously discussed with respect to FIGS. 5C and 6C, the more straight bimetallic guides 46 resulted in an increase in the axial velocity and/or mass flow rate of the working fluid, and, assuming a constant fuel flow, a decrease in the fuel-to-working-fluid ratio. It is believed that either or both of these effects contribute to blowing the combustion flame 28 out of the nozzle 14 and back into the combustion chamber 22. When the flame holding no longer exists, the temperature in the vicinity of the bimetallic guides 46 decreases, returning the curvature in the bimetallic guides 46 and restoring the tangential rotation to the fuel and working fluid mixture.

Figure 8:
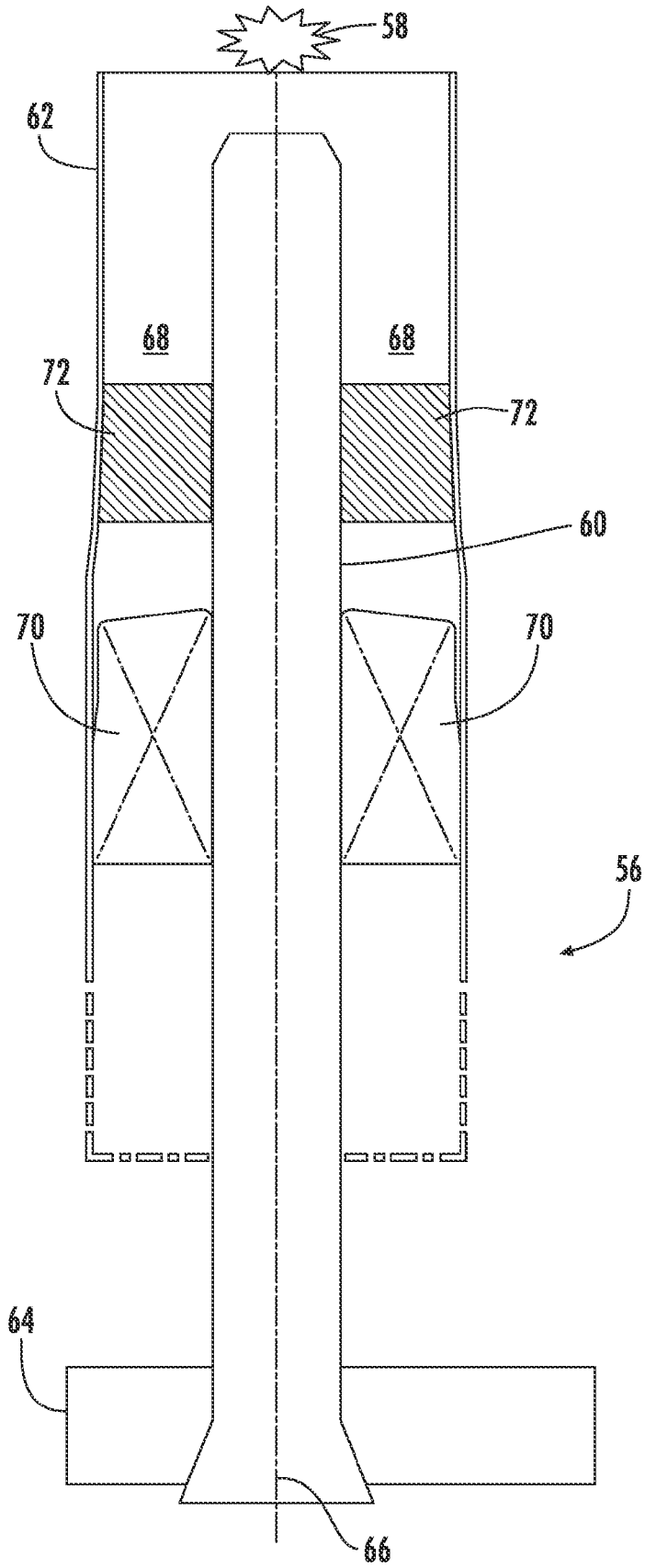
FIG. 8 is a cross-section of a nozzle according to an alternate embodiment of the present invention.
Figure 9:
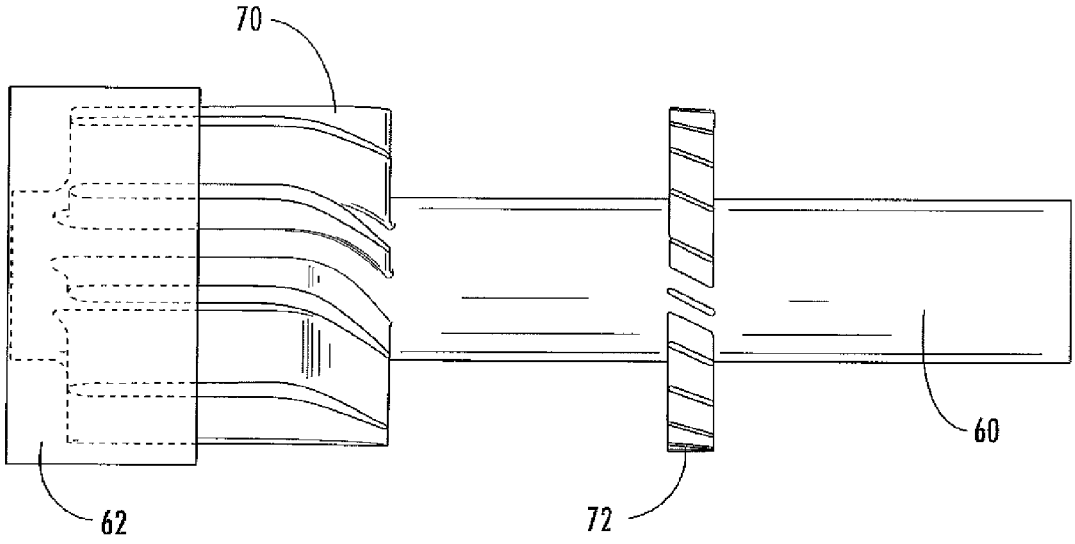
FIG. 9 is a perspective view of a partial cutaway of the nozzle shown in FIG. 8.

FIG. 8 shows a cross-section of a nozzle 56 according to an alternate embodiment of the present invention. As shown in FIG. 8, a combustion flame 58 exists downstream of the nozzle 56 in the combustion chamber 22 during normal operations. The nozzle 56 generally includes a center body 60, a shroud 62, a nozzle flange 64, an axial centerline 66, an annular passage 68, swirler or turning vanes 70, and bimetallic guides 72 as previously described with respect to the embodiment shown in FIG. 3. In this particular embodiment, however, the bimetallic guides 72 are downstream and separate from the turning vanes 70. In addition, as shown in the perspective view provided in FIG. 9, the turning vanes 70 are disposed in the annular passage 68 at an angle acute to the axial centerline 66 of the nozzle 56, and the bimetallic guides 72 are straight and generally aligned with the turning vanes 70 so as to not disturb the tangential velocity of the fuel and working fluid mixture during normal operations.

Figure 10:
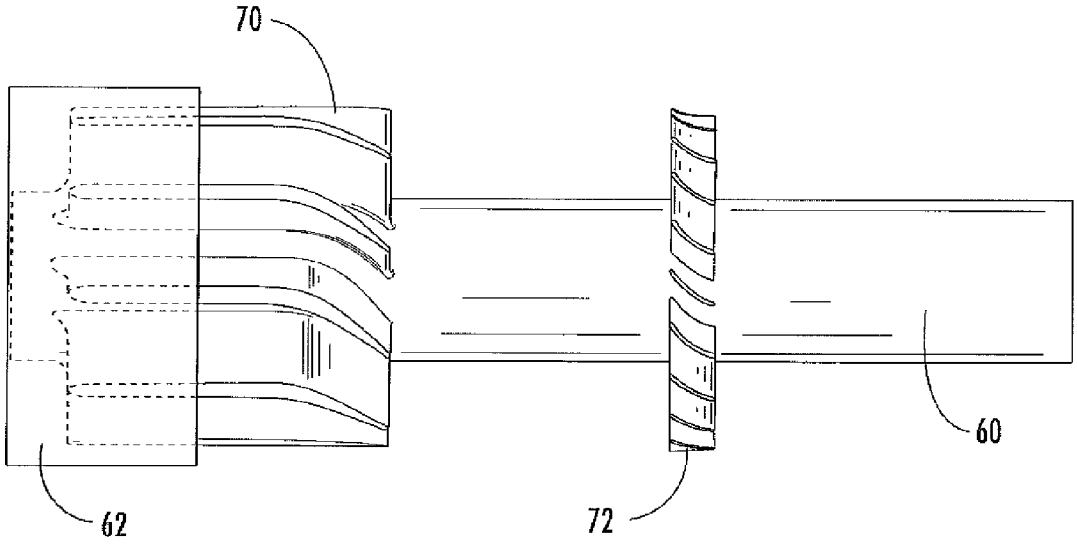
FIG. 10 is a perspective view of a partial cutaway of the nozzle shown in FIG. 8 responding to flame holding.

FIG. 10 provides a perspective view of a partial cutaway of the nozzle 56 shown in FIG. 8 responding to flame holding. The flame holding in the vicinity of the bimetallic guides 72 produces an increase in the temperature in the vicinity of the bimetallic guides 72. As a result, the bimetallic guides 72, comprised of two metals having different temperature coefficients of expansion, curve to deswirl, or reduce the tangential velocity, of the fuel-working fluid mixture, as shown in FIG. 10. The curved bimetallic guides 72 increase the axial velocity and/or mass flow rate of the working fluid and velocity magnitude upstream of the bimetallic guides 72. Since the swirl angle will remain approximately the same upstream of the bimetallic guides 72 and the mass flow increases, then the velocity magnitude (axial and tangential) increases, and, assuming a constant fuel flow, the fuel-to-working-fluid ratio decreases. It is believed that either or both of these effects contribute to blowing the combustion flame 58 out of the nozzle 56 and back into the combustion chamber 22. When the flame holding no longer exists inside the fuel nozzle, the temperature in the vicinity of the bimetallic guides 72 decreases, causing the bimetallic guides 72 to straighten and therefore becoming aligned to the swirling fuel and working fluid mixture.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle, comprising:

a. a center body;

b. a shroud circumferentially surrounding at least a portion of the center body to define an annular passage between the center body and the shroud; and c. a bimetallic guide between the center body and the shroud.

2. The nozzle as in claim 1, wherein the bimetallic guide extends continuously between the center body and the shroud.

3. The nozzle as in claim 1, further including a plurality of bimetallic guides between the center body and the shroud.

4. The nozzle as in claim 1, further including a vane between the center body and the shroud upstream of the bimetallic guide.

5. The nozzle as in claim 4, wherein the vane is integral with the bimetallic guide.

6. The nozzle as in claim 1, wherein the bimetallic guide is aligned parallel to a longitudinal axis of the nozzle.

7. The nozzle as in claim 1, wherein the bimetallic guide is aligned at an acute angle to a longitudinal axis of the nozzle.

8. The nozzle as in claim 1 wherein the bimetallic guide comprises two metals having different thermal coefficients of expansion.

9. A combustor, comprising:

a. an end cap;

b. a fuel nozzle disposed in the end cap, wherein the nozzle includes:

i. a shroud, wherein the shroud defines an annular passage in the nozzle; and ii. a bimetallic guide disposed in the annular passage.

10. The combustor as in claim 9, wherein the nozzle further includes a center body axially aligned in the nozzle.

11. The combustor as in claim 9, further including a plurality of bimetallic guides disposed in the annular passage.

12. The combustor as in claim 9, further including a vane disposed in the annular passage upstream of the bimetallic guide.

13. The combustor as in claim 12, wherein the vane is integral with the bimetallic guide.

14. The combustor as in claim 9, wherein the bimetallic guide is aligned parallel to a longitudinal axis of the nozzle.

15. The combustor as in claim 9, wherein the bimetallic guide is axially aligned with the nozzle.

16. A method for supplying fuel to a combustor, comprising:

a. flowing a working fluid through a nozzle;

b. injecting the fuel into the nozzle;

c. mixing the fuel with the working fluid to create a fuel and working fluid mixture;

d. swirling the fuel and working fluid mixture;

e. sensing flame holding in the nozzle with a bimetallic guide; and f. reducing the swirl in the fuel and working fluid mixture by changing a curvature of the bimetallic guide.

17. The method as in claim 16, further including increasing the mass flow rate of the working fluid through the nozzle.

18. The method as in claim 16, further including decreasing a tangential velocity of the fuel and working fluid mixture.

19. The method as in claim 16, further including decreasing a fuel-to-working-fluid ratio in the fuel and working fluid mixture.

20. The method as in claim 16, further including increasing an axial velocity of the fuel and working fluid mixture.

* * * * *